US006821164B2

(12) United States Patent
Mills et al.

(10) Patent No.: US 6,821,164 B2
(45) Date of Patent: Nov. 23, 2004

(54) CONNECTOR ASSEMBLY COMPRISING A TAB-RECEIVING INSULATED SPRING SLEEVE AND A DUAL CONTACT WITH PAIRS OF SPACED APART CONTACT MEMBERS AND TAILS

(75) Inventors: James Mills, Quebec (CA); Miguel Conde, Seal Beach, CA (US); Gerald Wolford, Montreal (CA)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/177,217

(22) Filed: Jun. 20, 2002

(65) Prior Publication Data

US 2003/0082957 A1 May 1, 2003

(30) Foreign Application Priority Data

Jun. 22, 2001 (CA) ..... 2351283

(51) Int. Cl.[7] ..... H01R 11/22
(52) U.S. Cl. ..... 439/851; 439/825
(58) Field of Search ..... 439/825, 874, 439/851, 849, 843, 850, 79, 61

(56) References Cited

U.S. PATENT DOCUMENTS

| | | | | | |
|---|---|---|---|---|---|
| 4,472,017 | A | * | 9/1984 | Sian | 339/217 |
| 4,755,145 | A | | 7/1988 | Johnson et al. | 439/61 |
| 4,954,090 | A | | 9/1990 | Shimochi | 439/76 |
| 5,342,226 | A | * | 8/1994 | Hayes et al. | 439/845 |
| 5,486,124 | A | * | 1/1996 | Wandler | 439/843 |
| 5,525,063 | A | * | 6/1996 | McMichen et al. | 439/61 |
| 5,639,258 | A | * | 6/1997 | Clark | 439/404 |
| 5,839,906 | A | * | 11/1998 | Leshem | 439/61 |
| 5,899,775 | A | * | 5/1999 | Davis et al. | 439/748 |
| 5,904,594 | A | * | 5/1999 | Longueville et al. | 439/608 |
| 6,276,945 | B1 | * | 8/2001 | Hayward et al. | 439/82 |
| 6,319,075 | B1 | * | 11/2001 | Clark et al. | 439/825 |

FOREIGN PATENT DOCUMENTS

| | | |
|---|---|---|
| DE | 19702233 A1 | 7/1998 |
| EP | 0517139 A2 | 6/1992 |

* cited by examiner

*Primary Examiner*—Alex Gilman
(74) *Attorney, Agent, or Firm*—Harrington & Smith, LLP

(57) ABSTRACT

A device for connecting an electrical contact to a flat bus bar conductor formed with a tab comprises a spring sleeve and a tubular shroud. The sleeve receives both the tab and the electrical contact in order to interconnect these tab and contact. The shroud has a first section in which the sleeve fits and a second section through which the tab is inserted in the sleeve, this second section being slotted to define a seat for the bus bar conductor. The electrical contact comprises a first pair of mutually spaced apart flat contact members, and a second pair of flat contact tails connected to the contact members and spaced apart from each other for insertion in the sleeve with the tab between them. An electrical connector comprises an electrically insulating housing formed with a cavity with front and rear openings, and the electrical contact having its contact members inserted in the cavity through the rear opening to form a conductor-receiving receptacle accessible through the front opening. Finally, a bus bar system comprises a backplane PCB comprising a rear face, at least one generally flat bus bar conductor running behind the backplane PCB and including an edge adjacent to the rear face of the backplane PCB and integral tabs distributed along this edge, and at least one opening cut into the backplane PCB for access and connection to at least one tab through the above described device and contact.

21 Claims, 8 Drawing Sheets

CONNECTOR ASSEMBLY COMPRISING A TAB-RECEIVING INSULATED SPRING SLEEVE AND A DUAL CONTACT WITH PAIRS OF SPACED APART CONTACT MEMBERS AND TAILS

BACKGROUND OF THE INVENTION

1. Field of the Invention

The present invention relates, in particular but not exclusively, to the field of bus bar assemblies. More specifically, the present invention relates to a device for connecting an electrical contact to a conductor provided with a tab, an electrical contact comprising a first pair of spaced apart contact members and a second pair of spaced apart contact tails, an electrical connector comprising an insulating housing and the electrical contact, a connector assembly comprising the connecting device and electrical contact, and a bus bar system with a backplane printed circuit board having at least one opening.

2. Brief Description of Earlier Developments

A large variety of conventional connector devices, electrical contacts, electrical connectors, connector assemblies and bus bar systems are available on the market.

Examples are given in the following US patents:
for spring sleeves:

| | | |
|---|---|---|
| 5,281,178 | Biscorner | 1994 |
| 5,554,040 | Sugiura et al | 1996 |

for electrical contacts:

| | | |
|---|---|---|
| 5,139,426 | Barkus et al. | 1992 |
| 5,158,471 | Fedder et al. | 1992 |

for connectors:

| | | |
|---|---|---|
| 4,352,533 | Murase et al. | 1982 |
| 4,703,394 | Petit et al. | 1987 |
| 5,360,349 | Provencher et al. | 1994 |
| 5,525,063 | McMichen et al. | 1996 |

for backplane systems:

| | | |
|---|---|---|
| 4,686,607 | Johnson | 1987 |
| 4,875,869 | Bruen et al. | 1989 |
| 6,129,591 | Czeschka | 2000 |

In spite of the large variety of such conventional devices, the industry still suffers from a lack of user friendly, safe connecting elements for use in combination, in particular but not exclusively, with the tabs of flat conductors forming part of a bus bar located beneath a backplane PCB (Printed Circuit Board).

An object of the present invention is to fulfil this need of the industry.

SUMMARY OF THE INVENTION

In accordance with a first aspect of the present invention, there is provided a device for connecting an electrical contact to a conductor provided with a tab, comprising a socket member structured to receive the tab of the conductor and the electrical contact in order to interconnect these tab and contact, and a tubular member having a first section in which the socket member fits and a second section through which the tab is inserted in the socket member, this second section defining a seat for the conductor.

According to preferred embodiments of the device:

the socket member comprises a metallic spring sleeve, and the spring sleeve comprises an axial slit;

the spring sleeve has a generally rectangular cross section and four rectangular walls, the axial slit extends centrally of one of these rectangular walls delimited by first and second axial corners of the spring sleeve, from the first axial corner said one wall deviates inwardly, bends a first time inwardly substantially at right angle, and bends a second time toward the second axial corner again substantially at right angle, and from the second axial corner said one wall deviates inwardly, bends a first time inwardly substantially at right angle, and bends a second time toward the first axial corner again substantially at right angle;

the spring sleeve has a generally rectangular cross section, the tab is generally flat, and the electrical contact comprises two generally flat and parallel contact tails which, when inserted in the spring sleeve along with the tab, are disposed on opposite sides of the generally flat tab;

the conductor is generally flat and the tab is integral and coplanar with this generally flat conductor, and the seat comprises two coplanar and axially extending slots in the second section of the tubular member;

the spring sleeve has a generally rectangular cross section, the tubular member comprises a shroud having a generally rectangular cross section and two narrow walls, and the two slots extend axially in the two narrow walls, respectively; and the shroud is made of electrically insulating material.

According to another aspect of the present invention, there is provided an electrical contact comprising a first pair of mutually spaced apart and electrically conductive contact members for insertion in a cavity of an electrically insulating housing to form a conductor-receiving receptacle, and a second pair of electrically conductive contact tails connected to the contact members and spaced apart from each other to receive between them an electrical conductor.

In accordance with preferred embodiments of this electrical contact:

the contact members are generally flat and parallel to each other, and the contact tails are generally flat and parallel to each other;

the contact members are generally parallel to the contact tails, and a spacing between the contact members is different from a spacing between the contact tails; and the contact members and contact tails are interconnected and made of a single piece of sheet metal, and the contact tails are embossed.

In accordance with a further aspect of the present invention, there is provided an electrical connector comprising:

an electrically insulating housing formed with a cavity having a front opening and a rear opening; and an electrical contact comprising:

a first pair of mutually spaced apart and electrically conductive contact members for insertion in the cavity through the rear opening to form a conductor-receiving receptacle accessible through the front opening; and a second pair of electrically conductive contact tails for insertion in a socket member, these contact tails being connected to the contact members, extending rearwardly from the housing, and being spaced apart from each other to receive between them an electrical conductor.

According to a preferred embodiment of the electrical connector, the electrically insulating housing is an elongated housing comprising a series of said cavities, and the electrical connector comprises a plurality of electrical contacts respectively associated to the cavities of the series.

Preferably, the electrical connector comprises in the housing additional conductor-receiving receptacles different from the conductor-receiving receptacles formed by the insertion of the first pairs of contact members in the respective cavities of the series.

According to a fourth aspect, the present invention relates to a connector assembly for use with an electrical conductor having a tab accessible through an opening in a board, comprising a tab-receiving socket member, a tubular member, and electrically insulating connector housing and an electrical contact. The tubular member has a first section in which the socket member fits and a second section through which the tab is inserted in the socket member, this second section defining a seat for the electrical conductor. The electrically insulating connector housing is located on one side of the board opposite to the electrical conductor and formed with a cavity having a front opening and a rear opening. The electrical contact comprises a first pair of mutually spaced apart and electrically conductive contact members for insertion in the cavity through the rear opening to form a conductor-receiving receptacle accessible through the front opening. The electrical contact further comprises a second pair of electrically conductive contact tails connected to the contact members, extending rearwardly from the connector housing and spaced apart from each other to receive between them the tab and for insertion in the socket member on opposite sides of the tab.

In accordance with a still further aspect, the present invention is concerned with a bus bar system comprising:

a backplane printed circuit board comprising a rear face;

at least one generally flat bus bar conductor running behind the backplane printed circuit board, this bus bar conductor comprising an edge adjacent to the rear face of the backplane printed circuit board and integral tabs distributed along this edge of the bus bar conductor; and at least one opening cut into the backplane printed circuit board for access and connection to at least one tab.

Preferably, the bus bar system comprises a plurality of parallel generally flat bus bar conductors running behind the backplane printed circuit board and comprising respective parallel edges coextending adjacent to the rear face of the backplane printed circuit board and groups of respective integral tabs distributed along these edges, and an opening cut into the backplane printed circuit board for each group of tabs for access and connection to these tabs, for example through the above described connecting device and electrical contact.

Advantageously, the bus bar system may comprise two backplane printed circuit boards each comprising a rear face. In this preferred embodiment, the generally flat bus bar conductors run behind the two backplane printed circuit boards, and each comprise two edges adjacent to the rear faces of the two backplane printed circuit boards, respectively, and integral tabs distributed along said two edges of the bus bar conductor, for example through the above described connecting device and electrical contact.

The foregoing and other objects, advantages and features of the present invention will become more apparent upon reading of the following non restrictive description of preferred embodiments thereof, given for the purpose of illustration only with reference to the accompanying drawings.

DETAILED DESCRIPTION OF THE PREFERRED EMBODIMENT

Figure 1:
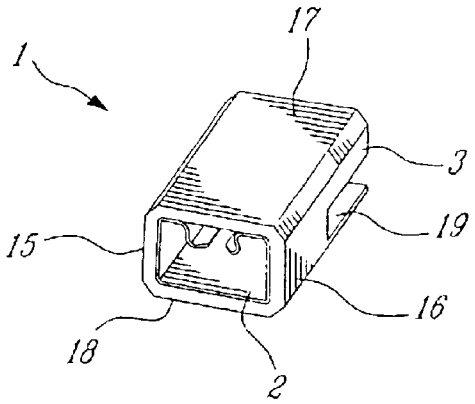
FIG. 1 is a perspective view of a device according to the present invention, for connecting an electrical contact with a tab of a bus bar conductor.

FIG. 1 of the appended drawings illustrates a device for connecting an electrical contact with a tab of a conductor, in particular but not exclusively a bus bar conductor. Device 1 comprises, in this preferred embodiment, a spring sleeve 2 and an electrically insulating tubular shroud 3.

Figure 2:
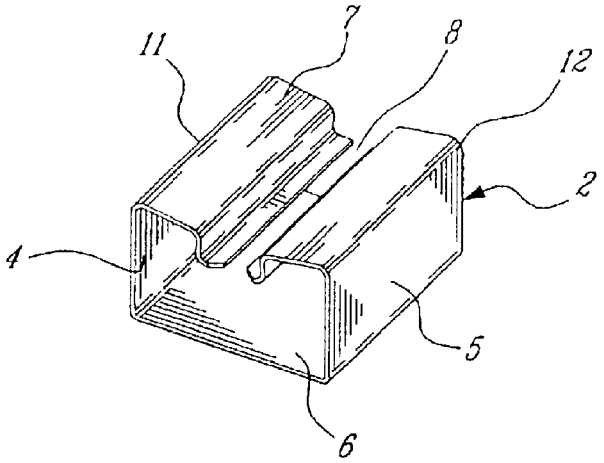
FIG. 2 is a perspective view of a spring sleeve forming part of the device of FIG. 1.
Figure 3:
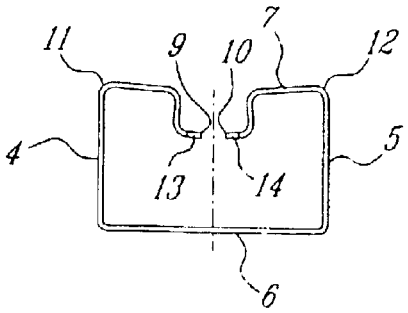
FIG. 3 is an elevational end view of the spring sleeve of FIG. 2.

Referring to FIGS. 2 and 3 of the appended drawings, the spring sleeve 2 has the general configuration of a parallelepiped. More specifically, the spring sleeve 2 has a generally rectangular cross section, two opposite narrow walls 4 and 5, and two opposite wide walls 6 and 7. Wall 7 is formed with a central, axial slit 8 therein.

Spring sleeve 2 is preferably made of a resilient conductive material such as spring metal. However, the use of other spring material to fabricate the sleeve 2 can also be contemplated. Referring to FIG. 3, the slit 8 is delimited by two axially extending, parallel and mutually facing edge surfaces 9 and 10. From axial corner 11 to the edge surface 9, wide wall 7 slightly diverges inwardly, bends a first time inwardly at substantially right angle, and bends a second time at substantially right angle toward axial corner 12. From axial corner 12 to the edge surface 10, wide wall 7 slightly diverges inwardly, bends a first time inwardly at substantially right angle, and bends a second time at substantially right angle toward corner 11. As explained in the following description, this shape of the spring sleeve 2 produces a spring action allowing the spring sleeve 2 to apply a pressure on the tab and contact tails inserted therein. In fact, the above described shape of the wall 7 defines two axially coextending lips having respective inner faces 13 and 14 to apply this pressure on the tab and contact tails.

The insulating shroud 3 is preferably made of electrically insulating material such as, for example, plastic material. The shroud 3 has a generally rectangular cross section and comprises, as illustrated in FIG. 1, two opposite narrow walls 15 and 16 and two opposite wide walls 17 and 18.

The internal dimensions of the shroud 3 are adapted to receive and fit the spring sleeve 2 in a first end section of the shroud 3 in an interface fit. Shroud 3 is therefore a captive, electrically insulating shroud which surrounds the spring sleeve 2 to prevent accidental electrocution. Since the insulating shroud 3 is longer than the spring sleeve 2, the spring sleeve 2 does not reside in the second remaining section of the shroud 3. As shown in FIG. 1, the second section of the shroud 3 is formed with two symmetrical, axially extending slots such as 19 out-of-center in the two narrow walls 15 and 16, respectively.

Figure 4:
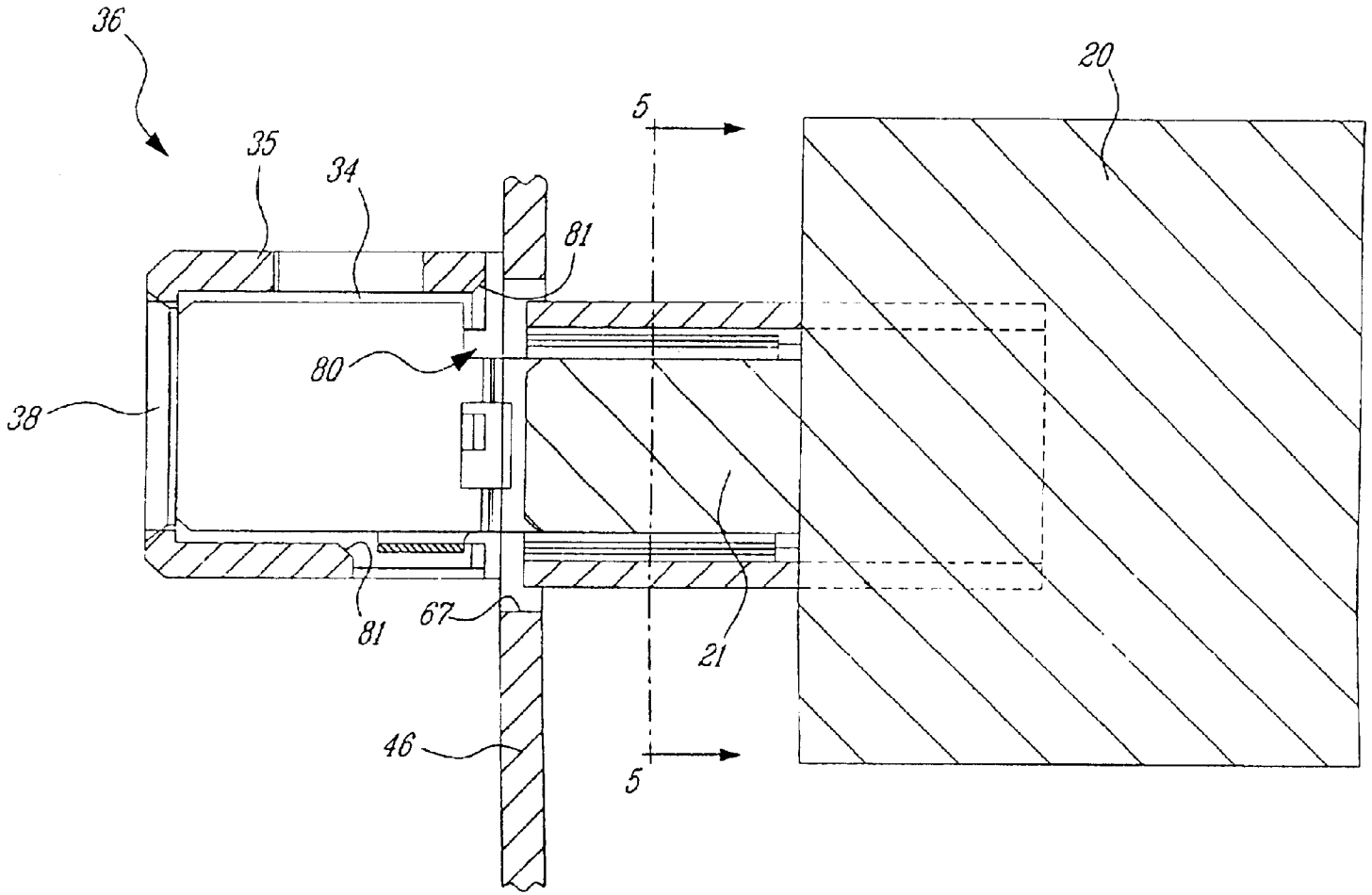
FIG. 4 is an elevational, cross sectional side view of the device of FIG. 1 connecting the electrical contact to the tab of the bus bar conductor.

As a non limitative example, the device 1 can be used in relation to a generally flat bus bar conductor 20. As shown in FIG. 4, the bus bar conductor 20 is formed with a tab 21. This tab 21 is inserted in the spring sleeve 2 through the second slotted section of the shroud 3. Upon insertion of tab 21 in spring sleeve 2, the flat bus bar conductor 20 is simultaneously introduced in the two slots such as 19 which form a seat for said bus bar conductor 20.

Figure 5:
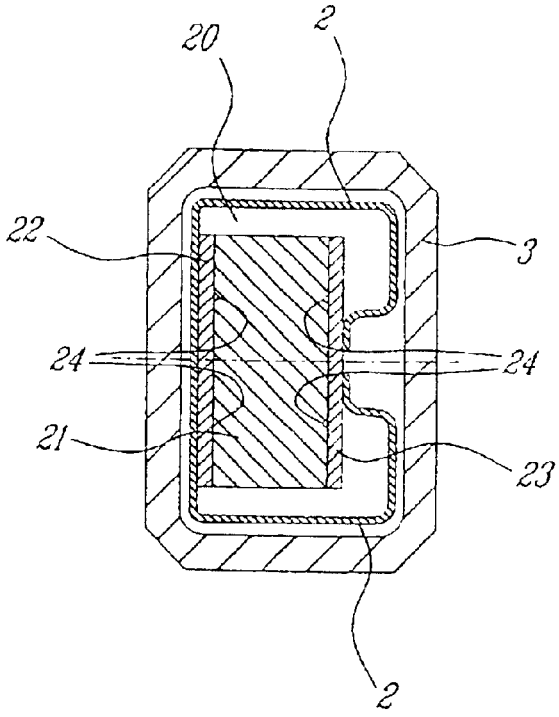
FIG. 5 is a cross sectional view of the device of FIG. 1 taken along line 5—5 of FIG. 4, while connecting the electrical contact to the tab of the bus bar conductor.

Finally two parallel, generally flat contact tails 22 and 23 are inserted in the spring sleeve 2 on opposite sides of the bus bar tab 21 (see FIG. 5). These contact tails 22 and 23 are part of an electrical contact 25 which will be described hereinafter. Preferably, a portion of the device 1 resides within an opening 67 in PCB 46.

Referring to FIG. 5, the spring sleeve 2 forms a socket member which is smaller than tails 22 and 23 and tab 21. Upon insertion of tails 22 and 23 and tab 21 into the sleeve, the resiliencey of sleeve 2 creates a semi permanent, high performance electrical contact at the interfaces between the contact tails 22 and 23 and the bus bar tab 21. In this respect, the contact tails 22 and 23 may be equipped with one or more bosses (see axial bosses 24 in FIGS. 5 and 6) designed to concentrate the contact force on given regions of the interfaces between these contact tails 22 and 23 and the bus bar tab 21. As seen in FIG. 4, both tails 22 and 23 and tab 21 extend into the opening 67 in PCB 46. Tails 22 and 23 extend entirely through opening 67 to the other side of PCB 46.

The resulting splice produces a compression force which establishes an electrical contact between the bus bar tab 21 and the contact tails 22 and 23. Just a word to mention that the spring sleeve 2 does not necessarily carry electric curent. In fact, spring sleeve 2 can be an electrically conducting sleeve or an electrically insulating sleeve.

Those of ordinary skill in the art will appreciate that this concept would also work with only one of the contact tails 22 or 23, situated on one side of the bus bar tab 21, provided that the dimensions of the spring sleeve 2 and shroud 3 be adapted accordingly.

Figure 6:
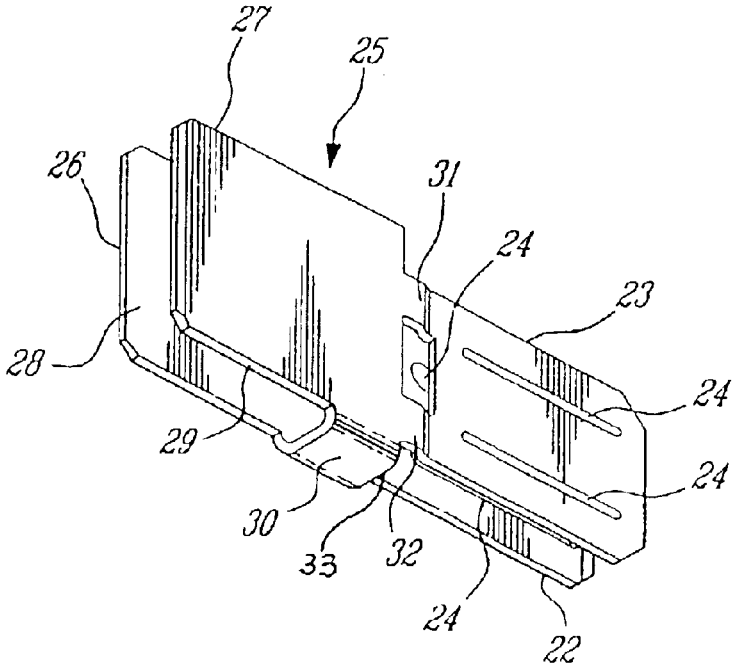
FIG. 6 is a perspective view of the electrical contact as shown in FIGS. 4 and 5, having a pair of contact tails to be connected to the tab of the bus bar conductor.
Figure 7:
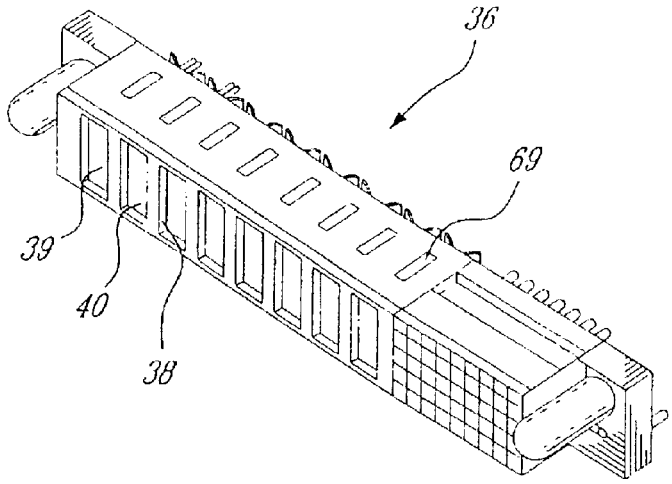
FIG. 7 is a perspective view of an electrical connector having a connector housing defining cavities each structured to receive contact members of an electrical contact as illustrated in FIG. 6.
Figure 8:
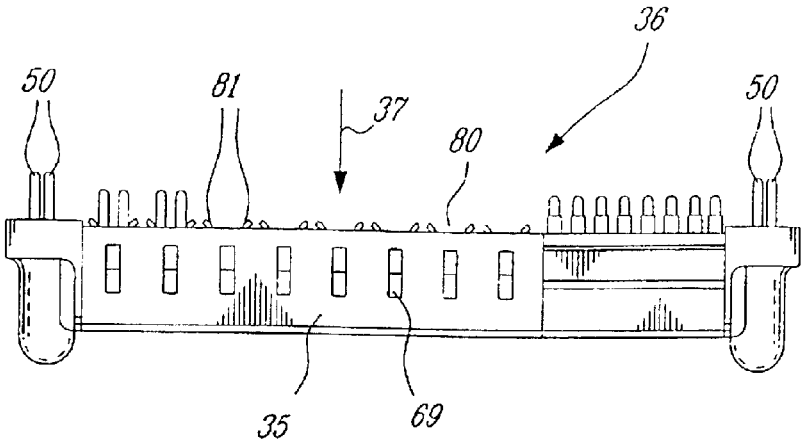
FIG. 8 is a top plan view of the electrical connector of FIG. 7.

Referring now to FIG. 6 of the appended drawings, the generally flat contact tails 22 and 23 form part of a one piece pass-thru bus bar electrical contact generally identified by the reference 25. Pass-thru bus bar contact 25 is made of a single piece of electrically conductive sheet metal cut and shaped as required. A similar "dual mass" contact is described in European Patent Application EP 0 951 102.

Figure 15:
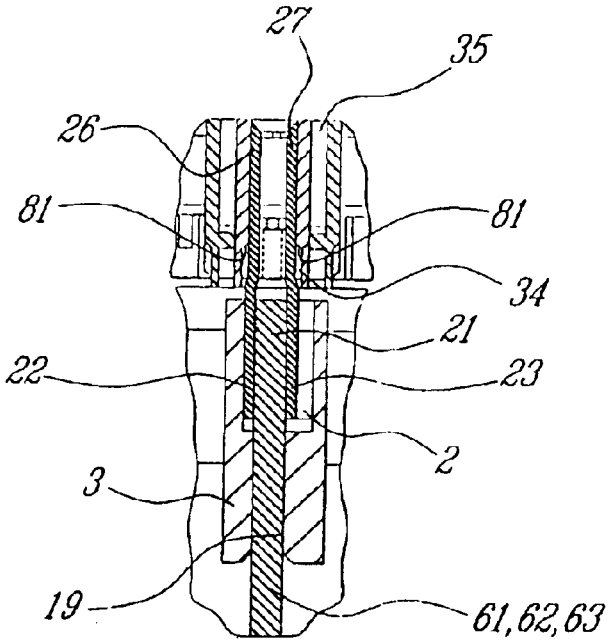
FIG. 15 is an enlarged view of a portion 150 of FIG. 14, showing electrical connection between (a) a tab of a bus bar conductor of the bus bar system of FIG. 12 and (b) the electrical connector of FIG. 7 through the device of FIG. 1 and the electrical contact of FIG. 6.

Contact 25 further comprises a pair of generally flat and parallel contact members 26 and 27 defining mutually facing mating surfaces 28 and 29. As illustrated, the contact members 26 and 27 are generally parallel to the contact tails 22 and 23. Also, as illustrated in FIG. 6, the spacing between the generally parallel contact members 26 and 27 is larger than the spacing between the parallel contact tails 22 and 23. However, it is within the scope of the present invention, as shown in FIG. 15, to provide contact members 26 and 27 with a spacing between them which is larger than the spacing between the parallel contact tails 22 and 23.

As illustrated in FIG. 6, a transverse, curved bridge member 30 electrically and mechanically interconnects the contact members 26 and 27. Contact member 27 and contact tail 23 are interconnected through a pair of spaced apart and suitably curved bridge members 31 and 32. Similarly, contact member 26 and contact tail 22 are interconnected through a pair of spaced apart and suitably curved bridge members of which only member 33 appears on FIG. 6.

Referring back to FIG. 4 of the appended drawings, the contact members 26 and 27 fit into a corresponding cavity 34 of an electrically insulating connector housing 35 made for example of injection-molded plastic material. The corresponding connector 36 is illustrated in FIGS. 7–11 of the appended drawings.

Figure 9:
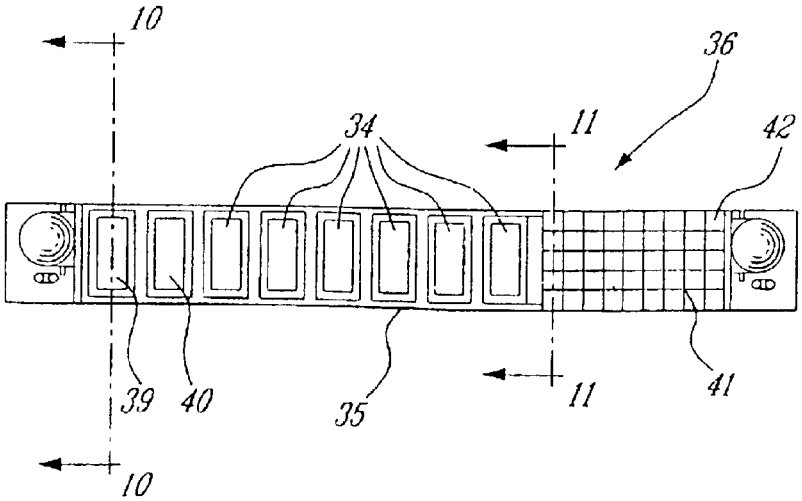
FIG. 9 is a front elevational view of the electrical connector of FIGS. 7 and 8.

As better shown in FIG. 9, the connector housing 35 comprises, as a non limitative example, a series of 6 laterally adjacent cavities 34. Each cavity 34 is designed to receive, from the rear of the connector housing, the contact 25 as indicated for example by the arrow 37 in FIG. 8 to form an electrically conductive conductor—receiving receptacle. To facilitate insertion of the contact members 26 and 27 of contact 25 in the respective cavities 34, the rear face of the connector housing 35 is provided, around each opening 80 (FIG. 4) leading to a cavity 34 with beveled borders identified by the reference 81. Also, each cavity 34 has a front peripheral inner border such as 38 to retain the contact members 26 and 27 in that cavity 34.

Figure 10:
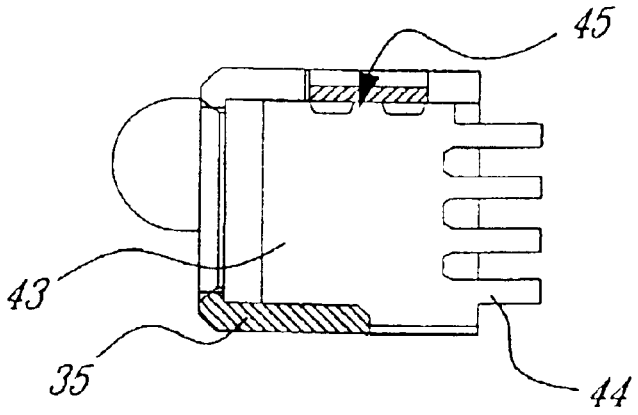
FIG. 10 is a cross sectional view of the electrical connector of FIGS. 7–9, taken along line 10—10 of FIG. 9.

On one side of the series of 6 laterally adjacent cavities 34, connector 36 could comprise a pair of laterally adjacent, rectangular, and electrically conductive front receptacles 39 and 40. FIG. 10 shows a cross sectional view of receptacle 39 taken along axis 10—10 of FIG. 9. As can be seen in FIG. 10, a pair of flat and opposite contact members such as 43 are mounted in a cavity 45 of the connector housing 35 to define the receptable 39. Each contact member 43 is provided with a set of 4 integral connection pins such as 44 extending rearwardly of the connector 36 for connection to through holes 70 in a printed circuit board (PCB) 46 (see FIGS. 4 and 13). Receptacle 40 is similar to receptacle 39. Of course, both contact members 43 and the corresponding cavity 45 are structured to fixedly mount the contact members 43 in the connector housing 35. Techniques for mounting the contact members 43 in the cavity 45 are believed to be otherwise well known to those of ordinary skill in the art, and accordingly will not be further described.

Figure 11:
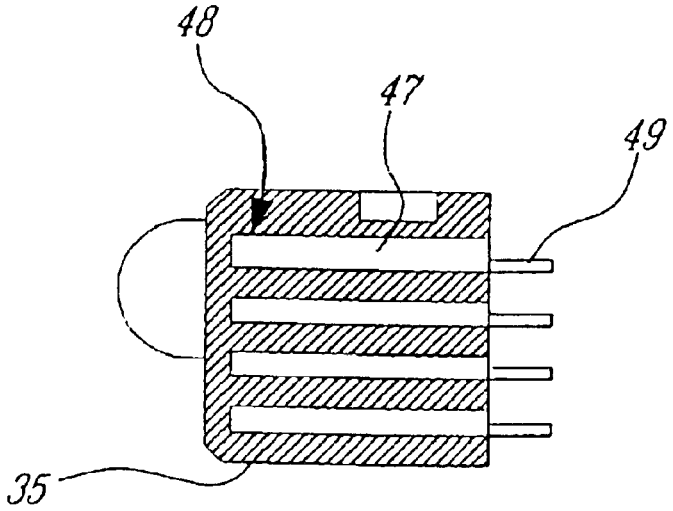
FIG. 11 is a cross sectional view of the electrical connector of FIGS. 7–9 taken along line 11—11 of FIG. 9.

On the other side of the series of 6 laterally adjacent cavities 34, the connector 36 could have a 4×8 matrix 41 of electrically conductive receptacle contacts such as 41 structured to receive electrically conductive pins (not shown) on the mating connector. FIG. 11 shows a cross sectional view of a column of receptacle openings 42 taken along axis 11—11 of FIG. 9. As can be seen in FIG. 11, contact 41 has a mating section 47, for example a tubular spring contact member, disposed in a cavity 48 of the connector housing 35 to receive the mating pin contact. Each contact 41 also has an integral mounting section 49 extending rearwardly of the connector 36 for connection to a backplane PCB (Printed Circuit Board) 46 (FIG. 4). All the receptacle contacts 41 are similar to each other. Of course, each mating section 47 and the corresponding cavity 48 are structured to fixedly mount the contact in the cavity. Techniques for mounting each contact members 47 in the corresponding cavity 48 are believed to be otherwise well known to those of ordinary skill in the art, and accordingly will not be further described in the present specification.

The connector 36 is secured to PCB 46 with hold-downs, each hold-down having barbed arms 50 extending rearwardly from the connector housing 35 for mechanically connecting the connector 36 to through holes 73 and 74 in the backplane PCB 46.

Finally, a pair of slot openings such as 69 are provided on opposite sides of the connector housing 35 at the level of each cavity 34 and 45. These slot openings are provided for the purpose of ventilating the cavity and dissipating electrical contact heat.

Accordingly, connector 36 is equipped with mixed PCB and pass-thru bus bar contacts. Electrical connector 36 can be a single- or multi-block (modular) separable connector equipped with mixed termination contacts; while some contacts attach to the backplane PCB through traditional means, e.g. solder, press-fit, etc., others pass through an opening cut in the backplane PCB to connect to a single or multiple bus bars running behind the PCB. Such a mix allows for a daughter board, equipped with the mating connector, to be fitted to the backplane PCB and send/receive power or signals to/from a common bus bar discretely situated behind the backplane PCB. This liberates space on the backplane PCB and allows for increased power distribution.

A non restrictive example of application of the above described device 1, electrical contact 25 and electrical connector 36 will now be described with reference to appended FIGS. 12–15.

Figure 12:
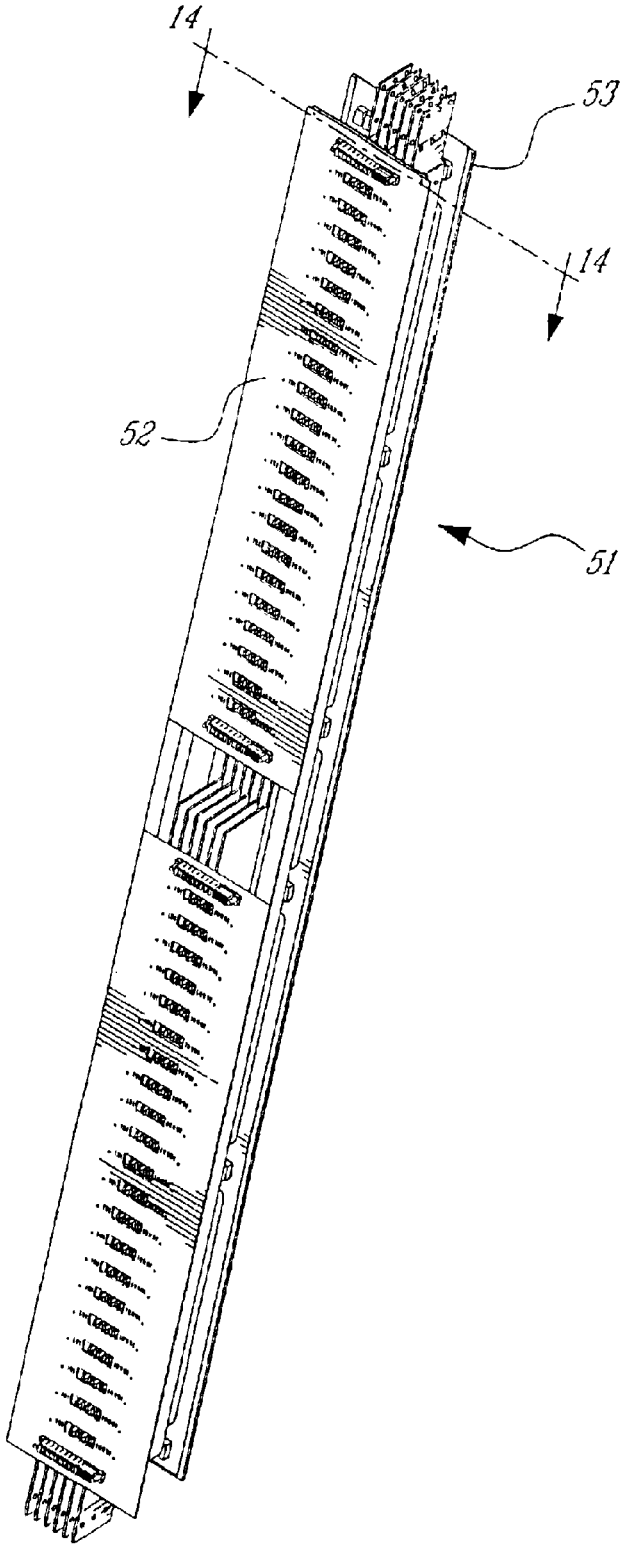
FIG. 12 is perspective view of a bus bar system in accordance with the present invention.
Figure 13:
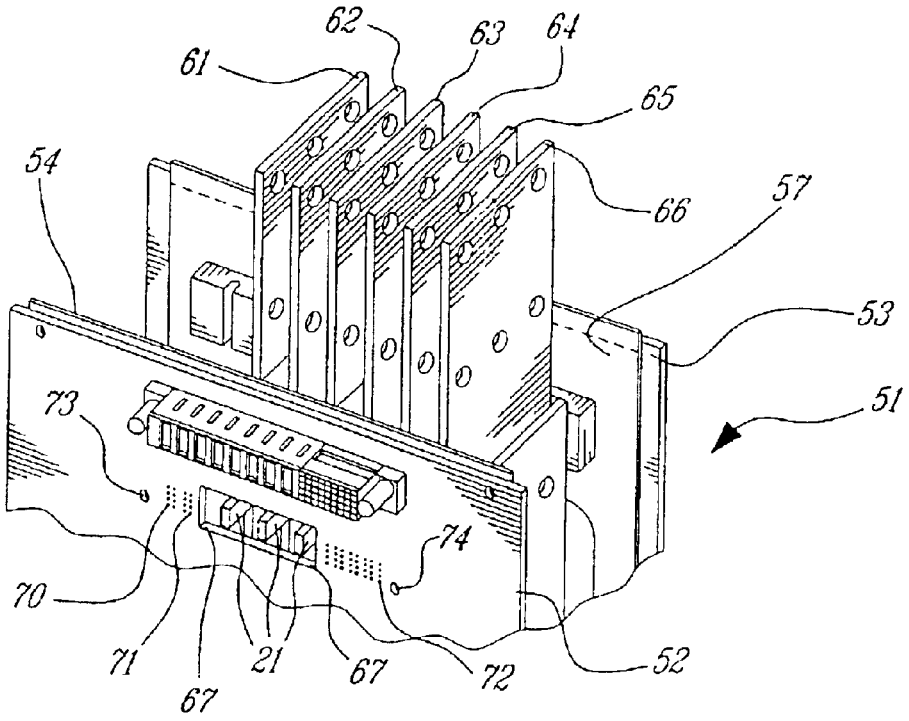
FIG. 13 is an enlarged, perspective end view of the bus bar system of FIG. 12.
Figure 14:
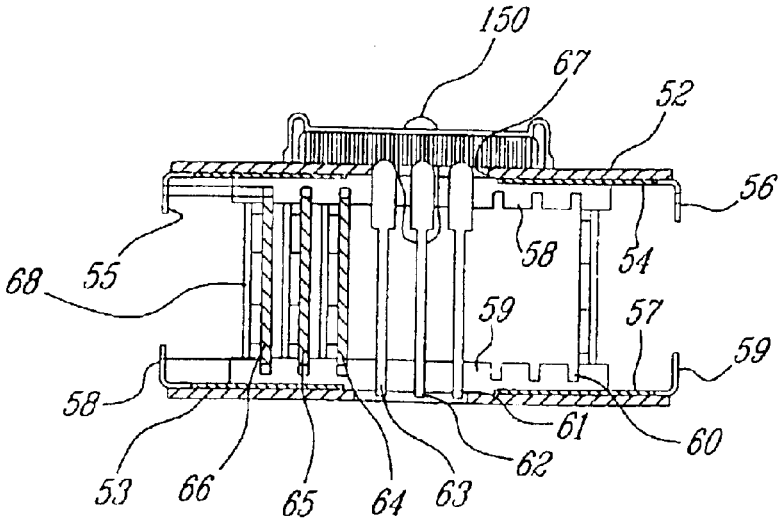
FIG. 14 is a cross sectional view of the bus bar system taken along line 14—14 of FIG. 12.

FIGS. 12, 13 and 14 illustrate an elongated backplane bus bar system 51. Backplane bus bar system 51 can distribute power and signals to the components and/or daughter boards mounted on one or a series of backplane PCB's such as 52 and 53. For safety, the backplane bus bar system 51 may be insulated along the spine or wherever electrical signal contact is not required. The backplane bus bar system 51 may also be a laminated assembly to allow for a mix of signal frequencies, voltages, grounding, EMI (Electromagnetic Interference) shielding, etc.

Backplane bus bar 51 comprises a pair of opposite elongated backplane PCB's 52 and 53. Backplane PCB 52 is mounted on a frame, preferably formed of a longitudinal metal plate 54 provided with symmetrical, opposite and longitudinal right angle flanges 55 and 56 to reinforce this metal plate. In the same manner, backplane PCB 53 is mounted on a frame, preferably formed of a longitudinal metal plate 57 provided with symmetrical, opposite and longitudinal right angle flanges 58 and 59 to reinforce this metal plate.

Distributed along the busbar system 51 are transversal busbar conductor supports such as 58 mounted to the inner side of the metal plate 54 and such as 59 mounted on the inner side of the metal plate 57. Each support 58 and 59 is formed with a series of transversal grooves such as 60 to receive corresponding backplane bus bar conductors such as 61–66.

A backplane busbar conductor is a generally flat bar of conductive metal with integral tabs such as 21 (FIGS. 4 and 13). These tabs 21 make electrical connection with contacts 25 by, for example, solder connection (not shown), crimp connection (not shown), or the preferred method of the separable spring sleeve described above. As illustrated in FIG. 13, opening such as 67 are cut in the backplane PCB's 52 and 53 and in the metal plate 54 and 57 to provide for access to these tabs 21.

Conductor heat sinks such as 68 are finally provided to dissipate heat from at least some of the bus bar conductors 61–66.

Finally, holes are provided in the backplane PCB's 52 and 53 at both ends of each opening 67. Referring to FIG. 13, holes 70 will receive the pins 44 of receptacle 39, holes 71 will receive the pins 44 of receptacle 40, and holes 72 will receive the pins 49 of the receptacles 42 of the matrix 41. Finally, the barbed arms 50 of the hold-down will hook in end holes 73 and 74 to mechanically connect and retain the connector 36 to the backplane PCB 52 or 53.

In the example of FIGS. 14 and 15, the electrical connector 36 can be installed as follows:

1. Three spring sleeves 2 are inserted in the non slotted end section of three corresponding shrouds 3 to form three devices 1 as illustrated in FIG. 1.
2. A first device 1 is positioned on tab 21 (FIG. 15) of bus bar conductor 61. More specifically, the device 1 is passed through the opening 67 to insert tab 21 in the spring sleeve 2. Simultaneously, the flat bus bar conductor 61 is introduced in the slots such as 19 of the shroud 3. The same operation is repeated for the second and third devices 1 to position these second and third devices on the tabs 21 of the flat bus bar conductors 62 and 63, respectively.
3. According to a first alternative, operation 3 consists of inserting the contact tails 22 and 23 in the spring sleeve 2 on the opposite sides of the tab 21. This operation is repeated for each busbar conductor 61–63 According to a second alternative, operation 3 consists of inserting the contact members 26 and 27 of a contact 25 in the corresponding cavity 34 from the rear of the connector housing 35 as indicated by the arrow 37 of FIG. 8. Of course, this operation is repeated for each bus bar conductor 61–63.
4. Connector 25 is placed. The pins 44 of the receptacles 39 and 40 extend through the corresponding holes 70 and 71, and the pins 49 of the receptacles 42 extend through the holes 72. During this operation, the two pairs of barbed arms 50 are inserted and hooked in the respective holes 73 and 74. During operation 4, according to the first alternative, the contact members 26 and 27 of the three contacts 25 slide and are inserted in the corresponding cavities 34 of the connector housing 35. During operation 4, according to the second alternative, the contact tails 22 and 23 of the three contacts 25 are inserted in the corresponding spring sleeves 2 on the opposite sides of the respective tab 21.

The pins 44 and 49 inserted in the holes 70–72 can be connected to the printed circuit of the PCB through soldering, press-fit, etc.

As can be seen in FIG. 15, the devices 1 and the pass-thru contacts 25 pass through the backplane PCB 46 and corresponding frame 54,57 without making electrical contact and preferably without physical contact.

Just a word to mention that, in the example of FIG. 6, the spacing between the contact tails 22 and 23 is smaller than the spacing between the contact members 26 and 27. On the contrary, in the example of FIG. 15, the spacing between the contact tails 22 and 23 is larger than the spacing between the contact members 26 and 27. The two alternatives are possible for adaptation to the intended application.

Therefore, the bus bar conductors are discretely mounted beneath one or more backplane PCB's. Such a backplane bus bar arrangement and its location beneath the backplane PCB allow for increased power or signal distribution without sacrificing board space.

Although the present invention has been described hereinabove by way of preferred embodiments thereof, these embodiments can be modified at will, within the scope of the appended claims, without departing from the spirit and nature of the subject invention.

Although the preferred embodiments have been described with reference to bus bar conductors, it is within the scope of the present invention to use the device 1, contact 25 and connector 36 in relation to conductors other than bus bar conductors.

What is claimed is:

1. A device for connecting an electrical contact to a conductor provided with a tab, comprising:

a socket member structured to receive the tab of the conductor and the electrical contact in order to interconnect said tab and contact; and a tubular member having a first section adapted to receive the socket member and a second section through which the tab is adapted to be inserted in the socket member, said second section defining a seat adapted to seat said conductor, wherein the tubular member is a shroud made of electrically insulating material.

2. A device as recited in claim 1, in which the socket member comprises a metallic spring sleeve.

3. A device as recited in claim 2, in which the spring sleeve comprises an axial slit.

4. A device as recited in claim 2, wherein:

the spring sleeve has a generally rectangular cross section;

the tab is generally flat; and the electrical contact comprises two generally flat and parallel contact tails which, when inserted in the spring sleeve along with the tab, are disposed on opposite sides of said generally flat tab.

5. A device for connecting an electrical contact to a conductor provided with a tab, comprising:

a socket member structured to receive the tab of the conductor and the electrical contact in order to interconnect said tab and contact; and a tubular member having a first section in which the socket member fits and a second section through which the tab is inserted in the socket member, said second section defining a seat for said conductor, in which the socket member comprises a metallic spring sleeve, and the spring sleeve comprises an axial slit, wherein:

the spring sleeve has a generally rectangular cross section, and four rectangular walls;

the axial slit extends centrally of one of said rectangular walls delimited by first and second axial corners of said spring sleeve;

from said first axial corner, said one wall deviates inwardly, bends a first time inwardly substantially at right angle, and bends a second time toward the second axial corner again substantially at right angle; and from said second axial corner, said one wall deviates inwardly, bends a first time inwardly substantially at right angle, and bends a second time toward the first axial corner again substantially at right angle.

6. A device for connecting an electrical contact to a conductor provided with a tab, comprising:

a socket member structured to receive the tab of the conductor and the electrical contact in order to interconnect said tab and contact; and a tubular member having a first section adapted to receive the socket member and a second section through which the tab is adapted to be inserted in the socket member, said second section defining a seat adapted to seat said conductor, wherein the socket member comprises a metallic spring sleeve and wherein the conductor is generally flat and the tab is integral and coplanar with said generally flat conductor; and the seat comprises two coplanar and axially extending slots in said second section of the tubular member.

7. A device as recited in claim 6, wherein;

the spring sleeve has a generally rectangular cross section;

the tubular member comprises a shroud having a generally rectangular cross section, and two narrower walls; and the two slots extend axially in said two narrower walls, respectively.

8. An electrical contact comprising:

a first pair of mutually spaced apart and electrically conductive contact members for insertion in a cavity of an electrically insulating housing, the contact members forming a conductor-receiving receptacle between the contact members; and a second pair of electrically conductive contact tails connected to the contact members and spaced apart from each other, the contact tails being adapted to receive an electrical conductor between the contact tails and clamp the conductor between the contact tails.

9. An electrical contact as recited in claim 11, wherein the contact members and contact tails are interconnected and made of a single piece of sheet metal.

10. An electrical contact as recited in claim 11, wherein the contact tails are embossed.

11. An electrical contact as recited in claim 8, wherein the contact members are generally flat and parallel to each other, and the contact tails are generally flat and parallel to each other.

12. An electrical contact as recited in claim 11, wherein the contact members are generally parallel to the contact tails, and wherein a spacing between the contact members is different from a spacing between the contact tails.

13. An electrical connector comprising:

an electrically insulating housing formed with a cavity having a front opening and a rear opening; and an electrical contact comprising:

a first pair of mutually spaced apart and electrically conductive contact members inserted in said cavity through the rear opening to form a conductor-receiving receptacle between the contact members accessible through the front opening; and a second pair of electrically conductive contact tails for insertion in a socket member, said contact tails being connected to the contact members, extending rearwardly from the housing, and being spaced apart from each other to receive between them an electrical conductor.

14. An electrical connector as recited in claim 13, wherein the electrically insulating housing is an elongated housing comprising a series of said cavities, and the electrical connector comprises a plurality of said electrical contacts respectively associated to the cavities of said series.

15. An electrical connector as recited in claim 14, wherein maid connector comprises in maid housing additional conductor-receiving receptacles different from the conductor-receiving receptacles formed by the insertion of maid first pairs of contact members in the respective cavities of said series.

16. An electrical connector as recited in claim 13, wherein the contact members are generally flat and parallel to each other, and the contact tails are generally flat and parallel to each other.

17. An electrical connector as defined in claim 16, wherein a spacing between the contact members is different from a spacing between the contact tails.

18. An electrical connector as recited in claim 16, wherein the contact members and contact tails are made of a single piece of sheet metal.

19. An electrical connector as defined in claim 16, wherein the contact tails are embossed.

20. A bus bar system comprising:

a backplane printed circuit board comprising a rear face;

at least one bus bar conductor running behind the backplane printed circuit board, said bus bar conductor comprising an edge adjacent to the rear face of the backplane printed circuit board and a tab along said edge of the bus bar conductor;

at least one opening cut into the backplane printed circuit board for access and connection to said tab; and wherein the bus bar system further comprises, for each tab accessible through one of said openings:

a socket member structured to receive the tab of the bus bar conductor;

a tubular member having a first section in which the socket member fits and a second section through which the tab is inserted in the socket member, said second section defining a seat for said bus bar conductor;

an electrically insulating housing formed with a cavity having a front; opening and a rear opening; and an electrical contact comprising:

a first pair of mutually spaced apart and electrically conductive contact member for insertion in said cavity through the rear opening to form a conductor-receiving receptacle accessible through the front opening; and a second pair of electrically conductive contact tails connected to the contact members, extending rearwardly from the housing and spaced apart from each other to receive between them the tab and for insertion in the socket member on opposite sides of said tab.

21. A connector assembly for use with an electrical conductor having a tab accessible through an opening in a board, comprising:

a tab-receiving socket member;

a tubular member having a first section in which the socket member fits and a second section through which the tab is inserted in the socket member, said second section defining a seat for said electrical conductor;

an electrically insulating connector housing located on one side of said board opposite to the electrical conductor and formed with a cavity having a front opening and a rear opening, and an electrical contact comprising:

a first pair of mutually spaced apart and electrically conductive contact members for insertion in said cavity through the rear opening to form a conductor-receiving receptacle accessible through the front opening; and a second pair of electrically conductive contact tails connected to the contact members, extending rearwardly from the connector housing and spaced apart from each other to receive between them the tab and for insertion in the socket member on opposite sides of the tab.

* * * * *

UNITED STATES PATENT AND TRADEMARK OFFICE

CERTIFICATE OF CORRECTION

PATENT NO. : 6,821,164 B2
DATED : November 23, 2004
INVENTOR(S) : Mills et al.

It is certified that error appears in the above-identified patent and that said Letters Patent is hereby corrected as shown below:

Column 11,
Lines 19 and 22, delete “maid” and replace with -- said --.

Signed and Sealed this

Fifth Day of April, 2005

JON W. DUDAS
*Director of the United States Patent and Trademark Office*